US005913436A

United States Patent [19]

Breuer

[11] Patent Number: 5,913,436

[45] Date of Patent: Jun. 22, 1999

[54] SCREW CAP, SPECIFICALLY COMPRISED OF PLASTIC, FOR CLOSING A BOTTLE OR THE LIKE

[75] Inventor: Hans-Werner Breuer, Laufen, Switzerland

[73] Assignee: Safety Cap System Ag, Switzerland

[21] Appl. No.: 08/704,766

[22] PCT Filed: Nov. 2, 1995

[86] PCT No.: PCT/EP95/00502

§ 371 Date: Sep. 26, 1996

§ 102(e) Date: Sep. 26, 1996

[87] PCT Pub. No.: WO95/26910

PCT Pub. Date: Oct. 12, 1995

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 3,455,478 | 7/1969 | Fields et al. | 215/252 |
| 4,352,436 | 10/1982 | Chartier et al. | 215/252 |
| 4,461,391 | 7/1984 | Davis | 215/252 |
| 4,529,096 | 7/1985 | Chartier et al. | 215/252 |
| 4,560,076 | 12/1985 | Boik . | |
| 5,033,632 | 7/1991 | Mattia et al. | 215/252 |

FOREIGN PATENT DOCUMENTS

| | | |
|---|---|---|
| 0 103 050 | 12/1982 | European Pat. Off. . |
| 0 281 284 | 9/1988 | European Pat. Off. . |
| 0 096 351 | 12/1993 | European Pat. Off. . |
| 2 527 558 | 1/1983 | France . |
| 3233805 C2 | 3/1984 | Germany . |
| 41 08 453 A1 | 3/1991 | Germany . |
| 92 12 753 | 11/1992 | Germany . |
| 2 202 217 | 9/1988 | United Kingdom . |

*Primary Examiner*—Stephen P. Garbe
*Attorney, Agent, or Firm*—Olson & Hierl, Ltd.

[57] ABSTRACT

A screw cap, made preferably of plastic, for closing a bottle or the like, with a cylindrical threaded section having a female thread to be screwed on the male thread of a bottle-neck, connected to the security ring via break points, on which there are inwardly-directed catches to engage with an outer collar on the neck of the bottle. The free edge (14) of the cylindrical part (13) has at least one axial projection (15) which engages positively in a recess (17) in the opposite edge of the security ring (11) in the circumferential direction and is releasable in the axial direction. This positive toothing ensures that, when the screw cap is first screwed on the neck of a bottle, the webs (10) are not sheared off by increased torque which can be applied if the catches run on the outer collar of the bottle-neck under tension.

2 Claims, 1 Drawing Sheet

SCREW CAP, SPECIFICALLY COMPRISED OF PLASTIC, FOR CLOSING A BOTTLE OR THE LIKE

BACKGROUND OF THE INVENTION

The invention relates to a screw cap of the type for closing a bottle or the like.

DE 41 08 453 A1 reveals a screw cap of the respective type, whereby the inwardly directed catches are hook shaped in order that, when the screw cap is first screwed on to the outer thread of a bottle neck, the catches snap on behind a circumferential outer collar arranged on the bottle neck for security purposes. When screwing the screw cap off the bottle, the hook shaped catches keep the security ring back from the outer collar on the bottle neck, so that the break points formed of thin webs between the security ring and the cylindrical part of the screw cap break off, and thus the security ring remains behind on the bottle neck. It is thus assured that the bottle has not previously been opened, since when the cap is unscrewed the security ring is held back on the bottle neck in a loose manner. It is thus easy for anyone to recognize whether the bottle has already been opened once.

A disadvantage to this known screw cap is i:hat a relatively great torque is required when the hook shaped catches on the security ring are moved over the outer collar on the bottle neck. As a result of this increased torque there is a risk that the break points formed of thin webs between the safety ring and the cylindrical part of the screw cap will shear off, even as the cap is screwed on, so that the security ring then rests loosely on the neck of the bottle, just as in the case where the bottle has been opened for the first time and has then been closed again. The fact that the contents of the bottle have never been opened is therefore not recognizable or guaranteed.

The invention has the task of devising a screw cap of the respective type, whereby the danger of shearing off the break points between the cylindrical part of the screw cap and the security ring is decreased during the initial screwing on of the cap.

The basic concept of the teaching consists of connecting the cylindrical part of the screw cap and the security ring in a firm locking manner in the circumferential direction, but permitting its removal in the direction of the threading. By positively engaging the opposing edges of the cylindrical part and the security ring, great torques can be transferred without the opposing movement of the two parts, so that there is no danger that the break points that connect the security ring with the cylindrical part of the screw cap in the original condition can be sheared or torn off.

The projection and the recess are expediently at right angles, whereby a plurality of projections and recesses are expediently provided, preferably engaging with each other in meander shaped manner. The webs can basically be located at any desired position, that is, for example, where no projections and recesses engage each other. Expediently, the break points are located between circumferentially juxtaposed surfaces of projections and recesses. The break points can also be formed by means of webs arranged between the projections and recesses. The toothing expediently extends over the entire circumference.

DETAILED DESCRIPTION OF THE PRESENT INVENTION

Figure 1:
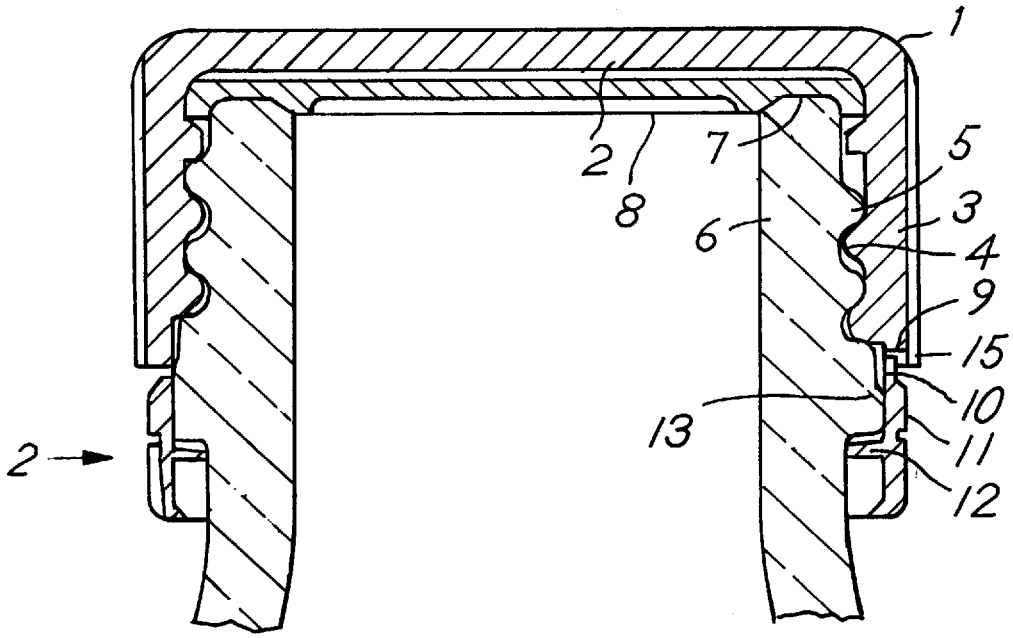
FIG. 1 shows an axial section through an exemplified embodiment of a screw cap according to the invention, together with the accompanying neck of the bottle.

FIG. 1 shows a screw cap 1 comprised of plastic according to an exemplified embodiment of the invention. It features a bottom 2 and a cylindrical threaded part 3, with an inner thread 4 to be screwed onto an outer thread 5 of a bottle neck 6, which is only partially illustrated. A gasket 8 is located between the bottom 2 and a face edge 7 of the bottle neck 6.

A lower edge 9 of the cylindrical part 3 is connected to a security ring 11 by means of webs 10, said security ring featuring inner catches 12.which engage an outer collar 13 on the bottle neck 6 in the illustrated state where the cap is to be screwed on.

Figure 2:
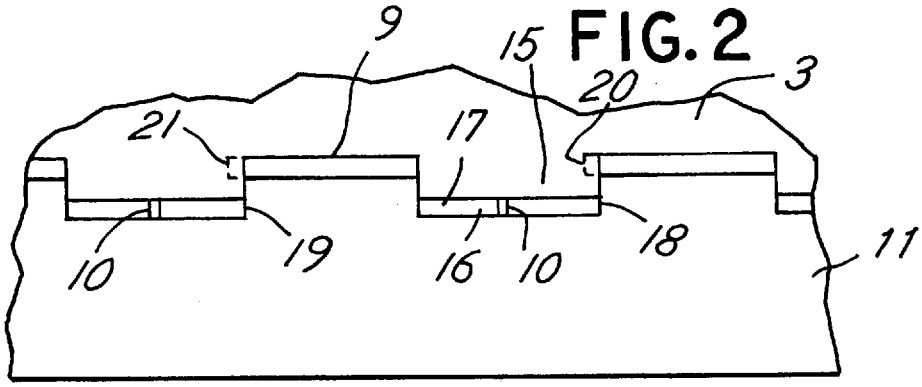
FIG. 2 is an enlarged view 11 on FIG. 1, illustrating webs connecting the safety cap and the security ring.

FIG. 2 shows a view II in FIG. 1. It shows that a lower edge 9 of the cylindrical part 3 features perpendicular projections 15 which engage flush with a side of the corresponding recesses 16 in the security ring 11. An intermediate space 17 is formed between the projections and the bottom of the recesses 16, wherein the webs 10 which hold the security ring 11 onto the cylindrical part are arranged.

During the initial screw on of a screw cap 1 according to FIG. 1 the projections 15 illustrated in FIG. 2 provide that the security ring 11 is taken along without any relative opposing movement, even when the torque is high, which is the case when the catches 12 run onto the outer collar 13 and move over it under tension. The thin webs 10 are thereby prevented from shearing or tearing off during the process of screwing on the cap.

Figure 3:
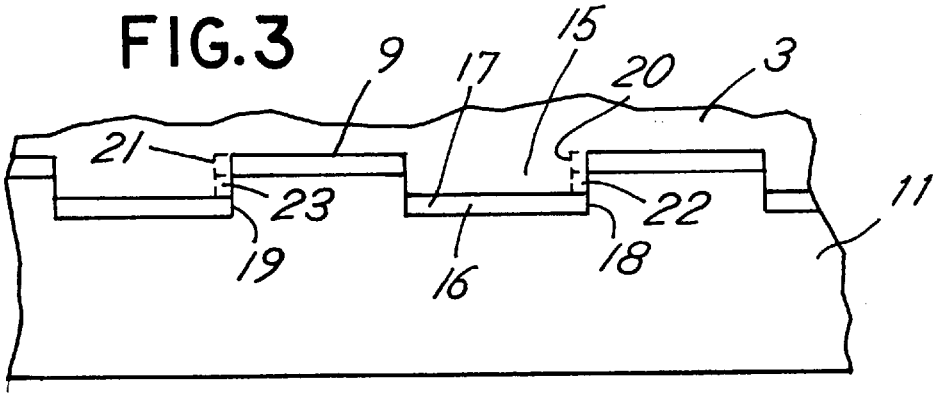
FIG. 3 is an enlarged view 11 on FIG. 1, illustrating break points connecting the safety cap and the security ring.

The projections 15 need only abut the opposing edges of the recesses 16 in the direction of screwing on the cap, but not necessarily in the opposite direction, the removal direction. At that position, for example in the area between surfaces 18, 19 and surfaces 20, 21, as indicated by dot-dash lines, break points 22, 23, (FIG. 3) indicated by shading, can then be arranged, serving the same purpose as the webs 10 that form the break points, and these webs can then be eliminated.

It will be understood that the webs 10 and the break points 22, 23 are connections between the cylindrical part 3 of the screw cap 7 and the security ring 11. The connections are thin strips (FIG. 2) or narrow areas (FIG. 3) that are adapted to be torn or severed by force. When a predetermined break force is exceeded, the connections, that is, webs or the break points 22, 23, will break, enabling the screw cap to be separated and removed from the security ring 11. In the present application, the webs 10 are disposed in the space 17 between the projections 15 and the bottoms of the recesses in the security ring 11, whereas the break points 22, 23 are in the areas between surfaces 18 and 19, respectively, on the security ring 11 and the surfaces 20, 21 respectively on the cylindrical part 3. The webs and break points can be used together, or they can be used alternatively, as desired.

In summary, before the rupturing of the webs 10, the security ring 11 will rotate a little bit together with the cap 1 and the cylindrical part 3 thereof. This movement does not influence the rupturing. Rupturing or severing of the webs 10 is affected by axial forces caused by the rotation of the cap 1 and cylindrical part 3 thereof by hand relative to the bottle neck. The complementary threads 4, 5 on the cap and bottle neck and the catching of the catches 12 of the security ring 11 below the outer collar 13 of the bottle neck 6 combine to apply an axial tensile force to the webs. When the force exceeds a predetermined value, the webs 10 will rupture or be severed.

I claim:

1. A screw cap comprised of plastic for closing a bottle or the like, said screw cap having a cylindrical threaded part that includes an inner thread for screwing onto an outer thread of a bottle neck, and that is connected to a security ring by means of break points, said cylindrical threaded part having a free edge, said security ring including inwardly directed catches to engage an outer collar on a bottle neck, the free edge of the cylindrical threaded part including an axial projection which positively engages in a recess in the opposite edge of the security ring, so as to lock in the circumferential direction and be removable in the axial direction, characterized by the fact that the break points (22,23) are formed between abutting surfaces (18,20;19,21) of the projection (15) and the recess (17) said projection having a side surface which is in engagement with a side surface of the recess.

2. A screw cap comprised of plastic for closing a bottle or the like, said screw cap having a cylindrical threaded part that includes an inner thread for screwing onto an outer thread of a bottle neck, and that is connected to a security ring by means of break points formed of thin webs, said cylindrical threaded part having a free edge, said security ring including inwardly directed catches to engage an outer collar on a bottle neck, the free edge of the cylindrical threaded part including an axial projection which positively engages in a recess in the opposite edge of the security ring, so as to form a lock in the circumferential direction and be removable in the axial direction, characterized by the fact that the thin webs are formed between adjacent surfaces of the projection and the recess said projection having a side surface which is in engagement with a side surface of the recess.

* * * * *

UNITED STATES PATENT AND TRADEMARK OFFICE

CERTIFICATE OF CORRECTION

PATENT NO. : 5,913,436

DATED : June 22, 1999

INVENTOR(S) : Hans-Werner Breuer

It is certified that error appears in the above-identified patent and that said Letters Patent is hereby corrected as shown below:

On the title page, item: [22], delete "Nov. 2, 1995" and insert --Feb. 11, 1995--.

Column 1, line 24, delete "i:hat" and insert --that--.

Signed and Sealed this

Thirtieth Day of November, 1999

*Attest:*

*Attesting Officer*

Q. TODD DICKINSON

*Acting Commissioner of Patents and Trademarks*